United States Patent [19]

Deverrewaere

[11] 4,264,944

[45] Apr. 28, 1981

[54] HEADLAMP ASSEMBLIES FOR MOTOR VEHICLES

[75] Inventor: Alain Deverrewaere, La Varenne, France

[73] Assignee: Cibie Projecteurs, Paris, France

[21] Appl. No.: 28,035

[22] Filed: Apr. 9, 1979

[30] Foreign Application Priority Data

Apr. 28, 1978 [FR] France ..... 78 12735

[51] Int. Cl.[3] ..... F21V 7/00

[52] U.S. Cl. ..... 362/61; 362/247; 362/267

[58] Field of Search ..... 362/61, 80, 83, 235, 362/247, 267, 296, 306, 327, 341, 369, 390

[56] References Cited

U.S. PATENT DOCUMENTS 2,281,643 5/1942 Wahlberg ..... 362/83

FOREIGN PATENT DOCUMENTS 194029 2/1938 Fed. Rep. of Germany ..... 362/247
2040360 6/1971 Fed. Rep. of Germany ..... 362/267
2016961 10/1971 Fed. Rep. of Germany ..... 362/267
1417486 10/1965 France ..... 362/267
1457375 12/1976 United Kingdom ..... 362/267

*Primary Examiner*—L. T. Hix
*Assistant Examiner*—Alan Mathews
*Attorney, Agent, or Firm*—Alan H. Levine

[57] ABSTRACT

A headlamp assembly comprises an optical unit adjustable mounted within an outer shell (24), which may in some cases be part of the vehicle bodywork. The optical unit comprises a reflector (10), a lens (not shown) permanently bonded to the front of the reflector, a main lamp (20), and a side-light bulb (54) in a lamp-holder (14). The rear of the outer shell (24) is closed by a one-piece seal (30) molded in an elastomer, which seal has a central portion (34) which lies against the rear of the reflector (10), to seal off the space between the shell and the reflector from the electrical connections to the lamps (20, 54). The side-light holder (14) is mounted from the rear in a passage (50) in a thickened portion (48) of the seal (30). The central portion (34) of the seal is connected to the portion (32) connecting the seal to the shell (24) by a flexible re-entrant sleeve or bellows portion (36, 38), which accommodates adjusting movements of the optical unit.

7 Claims, 1 Drawing Figure

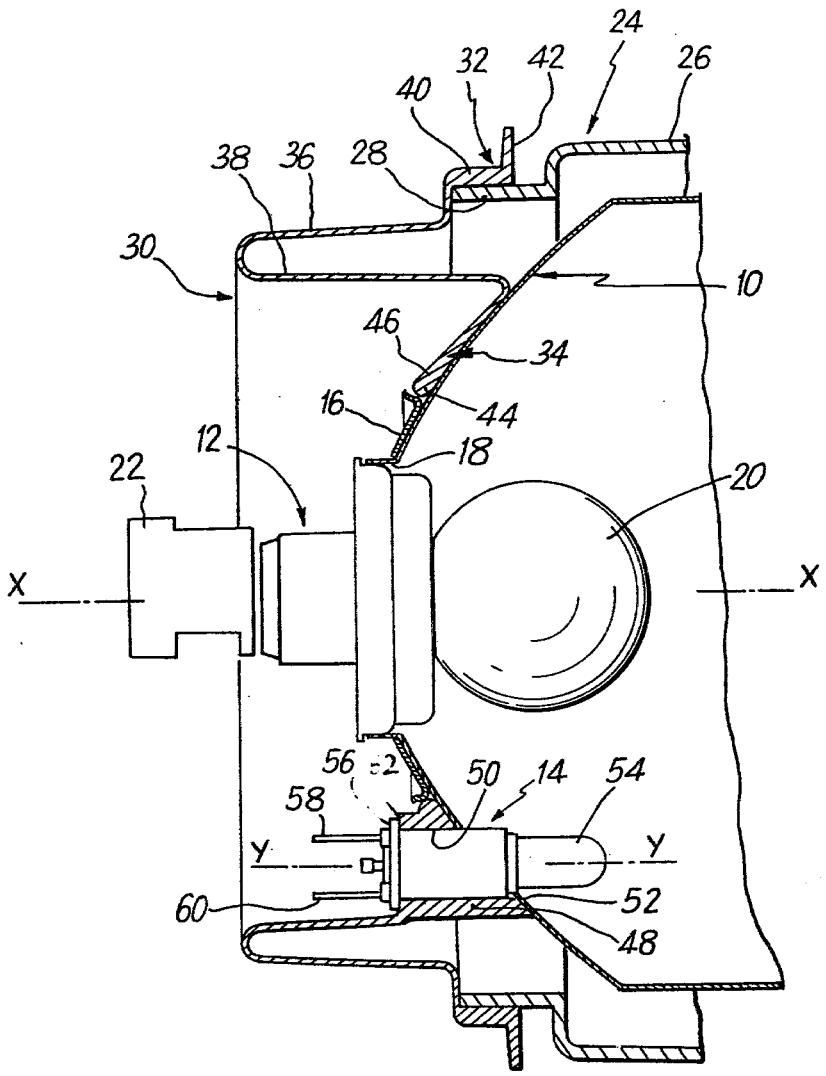
24
26
32
42
40
38
36
28
30
10
46
34
16
44
12
18
22
20
X
X
56
50
14
54
58
Y
Y
60
52
48

HEADLAMP ASSEMBLIES FOR MOTOR VEHICLES

BACKGROUND

1. Field of the Invention

This invention relates to headlamp assemblies for motor vehicles, and, more particularly, to improved arrangements for protecting a headlamp assembly which incorporates both a main lamp and a side-light bulb from the ingress of contaminants.

2. The Prior Art

A typical previously-proposed headlamp assembly comprises an optical unit mounted within an outer shell having front and rear openings. The optical unit comprises a front lens occupying the front opening of the shell, a reflector, a main lamp mounted on or adjacent the optical axis of the reflector, and a side-light bulb held in a side-light lamp-holder offset from the said optical axis. A window was provided in the reflector for the side-light bulb; more specifically, the reflector had an opening within which the side-light lamp-holder itself was mountd, with the interposition of a sealing ring. The components of the optical unit were partially protected from contaminants by a protective cap fitted over the rear opening of the outer shell, and having a smaller opening through which electrical leads pass to supply current to the main lamp and the side-light bulb.

The use of such a protective cap could not prevent contaminants which had penetrated into the space between the outer shell and the reflector from reaching the connections between the electrical leads and the main lamp and the side-light bulb.

Also, the opening in the reflector for the side-light lamp-holder has to be fairly large.

Finally, the replacement of a side-light bulb required the protective cap to be separated from the optical unit, to gain access to the side-light lamp-holder.

SUMMARY OF THE INVENTION

According to the invention, a protective element is provided in the form of a flexible member having an outer peripheral portion adapted to be connected to the edge of the outer shell, around the rear opening thereof, and a central portion having an opening whose edge encircles the main lamp. The central portion seals against the rear surface of the reflector, around the opening in the central portion, and has a thickened portion affording a passage which registers with the window in the reflector for the side-light bulb. The side-light lamp-holder is received in this passage, and the outer peripheral portion of the protective element is connected to the central portion thereof by a deformable folded annular portion.

For example, the deformable folded annular portion may be of bellows or re-entrant sleeve shape.

A protective element of this type, by virtue of its flexibility, can remain in sealing contact with the rear of the reflector, even when the position of the optical unit within the outer shell is adjusted.

Also, the invention makes it possible to arrange that the side-light lamp-holder can be removed from the rest of the headlamp assembly, allowing replacement of the side-light bulb, without removing the protective element.

Finally, the window in the reflector can be made smaller, because the side-light lamp-holder does not have to pass through it, and no sealing ring is required for this window.

In a preferred embodiment, the outer peripheral portion of the protective element forms, in effect, a ring having an L-shaped cross-section, one leg of which extends parallel to the optical axis of the reflector, and fits around the edge of the outer shell, adjacent the rear opening thereof, while the other leg of the L-shaped cross-section extends generally radially outwards, forming a portion which can be gripped during assembly of the headlamp, and also forming a gutter.

Also in the preferred embodiment, the main lamp is held in place in the optical unit by fastening devices attached to an annular collar secured to the rear surface of the reflector, which collar extends around the main lamp, and the edge of the opening in the protective element bears against the collar. In this case, the central portion of the protective element preferably increases in thickness towards the edge of the opening thereof, to provide a thickened bead.

BRIEF DESCRIPTION OF THE DRAWING

The invention may be carried into practice in various ways, but one specific embodiment will now be described by way of example, with reference to the accompanying drawing, of which the single FIGURE is a longitudinal section through part of a headlamp assembly embodying the invention.

DESCRIPTION OF THE PREFERRED EMBODIMENT

The headlamp assembly comprises a parabolic reflector 10, a main lamp 20 received in a lamp-holder 12, a side-light lamp 54 received in a lamp-holder 14, and a front lens (not shown). The front lens hermetically closes the front of the reflector 10, for example by being glued to the rim of the reflector, around its front opening. The holder 12 for the main lamp is inserted from the rear into a circular aperture 18 in the rear of the reflector 10, so that the main lamp 20 lies on the optical axis (shown at X—X) of the reflector 10. The holder 12 is kept in place in the aperture 18 by means of fasteners (not shown) which are mounted on a collar 16 which is secured to the rear of the reflector 10, around the aperture 18.

A connector 22 is provided to establish electrical connection between the wiring of the vehicle and the lamp-holder 12.

The assembly of reflector 10, front lens, lamps and lamp-holders is mounted within a shell 24 by means of screws (not shown), which also serve to adjust the position of this assembly within the shell 24, when necessary. The shell 24 has a peripheral wall 26 which continues forward to define a front opening of the shell, while at its rear end, the shell has a portion 28 of slightly reduced diameter, leading to a rear opening. The shell 24 may be made as an integral part of the vehicle body, although it is not illustrated as such in the present case.

A seal 30 closes the rear end of the space between the reflector 10 and the shell 24, and therefore prevents any contaminants which may penetrate into this space from reaching the space to the rear of the headlamp assembly, which latter space contains such components as the electrical connector 22. The seal 30 is a one-piece moulding of a flexible plastics material, and includes a peripheral lip 32 which fits around the reduced diameter portion 28 of the shell 24. More particularly, the lip 32 is of L-section, having a cylindrical part 40 which actually contacts the shell 24, and a radially outwardly extending portion 42 which forms a gutter around the shell, and facilitates assembly by providing a portion which can be gripped. The seal 30 also includes, connected to the lip 32, a deformable portion in the form of a re-entrant sleeve. The outer wall of the sleeve, which extends rearwards from the lip 32, is shown at 36, and changes direction smoothly at its rear end to form the inner wall of the sleeve, which is shown at 38, lying within the outer wall 36. The inner wall 38 continues forward nearly as far as the rear surface of the reflector 10, where it merges with an annular sealing portion 34 which lies against the rear surface of the reflector 10. The shape of the sealing portion 34 is such that it can lie snugly against the rear of the reflector. The sealing portion 34 increases in thickness from its outer edge towards its central opening; the edge of the central opening is shown at 44, and fits against the outer periphery of the collar 16.

The sealing portion 34 also has, in its zone below its central opening, a greatly thickened portion 48, which has a cylindrical passage 50 whose axis (shown at Y—Y) is parallel to the optical axis X—X of the reflector 10. This passage registers with an oepning 52 in the reflector, and the side-light lamp-holder 14, with the bulb 54, is inserted from the rear into this passage; the lamp-holder is a tight fit in the passage, in order that it shall stay in place. The lamp-holder 14 has an encircling rib 56, of larger diameter than the passage 50. When the lamp-holder 14 has been inserted into the bore 50 to the correct depth, the rib 56 abuts against the rear surface (shown at 62) of the thickened portion 48. The lamp-holder 14 also has two electrical contacts 58 and 60 which provide the electrical circuit to the side-light bulb 54.

The seal 30 is preferably made from a compact elastomer, such as the chloro-sulphonated polyethylene marketed as 'Hypalon' (Registered Trade Mark), or ethylene propylene terpolymer.

It will be understood that the shape of the seal 30 can be adapted for use in virtually any headlamp assembly comprising a reflector-lens assembly mounted within an outer shell.

What I claim as my invention and desire to secure by Letters Patent is:

1. In a headlamp assembly for a motor vehicle, comprising:

(a) an outer shell having front and rear openings, (b) a reflector within said shell and spaced from it by an annular space, said reflector having an optical axis, a main lamp on or adjacent the optical axis, and a side-light bulb held in a side-light lamp holder offset from the optical axis, said reflector having a window for the side-light bulb, the improvement comprising a flexible annular protective element closing the annular space between said shell and reflector, said protective element including:

I. an outer peripheral portion engaged over the rear end of said shell,

II. a central portion having an opening, the edge of the opening surrounding said main lamp, and said central portion sealing against the rear surface of said reflector, III. a thickened portion in said central portion, and a passage in said thickened portion having an axis parallel to the optical axis of the reflector and aligned with said window in said reflector, said side-light lamp holder being tightly accommodated within said passage, and IV. a portion connecting said outer peripheral portion and said central portion, said connecting portion being folded upon itself to define concentric outer and inner walls, and said connecting portion deforming in response to adjusting movements of said reflector with respect to said shell so that such movements do not disturb the engagement of the outer peripheral portion with said shell or the engagement of said central portion with said reflector.

2. In a headlamp assembly according to claim 1, wherein said outer peripheral portion of said protective element has an L-shaped cross-section, one leg of which extends parallel to the optical axis of said reflector, and fits around edge of the said outer shell adjacent said rear opening thereof, while the other leg of said L-shaped cross-section extends generally radially outwards from said one leg.

3. In a headlamp assembly according to claim 1, wherein said main lamp is held in place in said optical unit by fastening devices attached to an annular collar secured to the rear surface of said reflector, said collar extending around said main lamp, and said edge of said opening in said protective element bears against said collar.

4. In a headlamp assembly according to claim 3, wherein said central portion of said protective element increases in thickness towards said edge of said opening thereof, to provide a thickened bead.

5. In a headlamp assembly according to any of claims 1, 2, 3, or 4, wherein the protective element is a molding of a compact elastomer.

6. In a headlamp assembly according to any of claims 1, 2, 3, or 4, wherein the protective element is a molding of chloro-sulphonated polyethylene.

7. In a headlamp assembly according to any of claims 1, 2, 3, or 4, wherein the protective element is a molding of ethylene propylene terpolymer.

* * * * *